US008761426B2

(12) United States Patent
Miyata et al.

(10) Patent No.: US 8,761,426 B2
(45) Date of Patent: Jun. 24, 2014

(54) HOUSING STRUCTURE FOR SOUND GENERATOR

(71) Applicant: Anden Co., Ltd., Anjo (JP)

(72) Inventors: Susumu Miyata, Anjo (JP); Makoto Tsuruta, Hekinan (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 13/714,529

(22) Filed: Dec. 14, 2012

(65) Prior Publication Data

US 2013/0187523 A1 Jul. 25, 2013

(30) Foreign Application Priority Data

Jan. 23, 2012 (JP) ..... 2012-011273

(51) Int. Cl.
*H04R 1/02* (2006.01)
*G10K 9/22* (2006.01)
*G10K 11/00* (2006.01)

(52) U.S. Cl.
CPC ..... *H04R 1/023* (2013.01); *H04R 2499/13* (2013.01); *G10K 9/22* (2013.01); *G10K 11/004* (2013.01)
USPC ..... 381/345; 381/389; 381/189

(58) Field of Classification Search
CPC ..... H04R 1/023; H04R 2499/13; G10K 9/22; G10K 11/004
USPC ..... 381/86, 150, 189, 332, 335, 341, 345, 381/351, 389, 391, 361, 386; 181/149, 152
See application file for complete search history.

(56) References Cited

U.S. PATENT DOCUMENTS

| | | | | | |
|---|---|---|---|---|---|
| 3,987,258 | A * | 10/1976 | Tsutsui et al. | ..... | 381/334 |
| 6,128,394 | A * | 10/2000 | Hayakawa et al. | ..... | 381/386 |
| 2006/0177089 | A1 * | 8/2006 | Greco et al. | ..... | 381/391 |
| 2009/0242319 | A1 * | 10/2009 | Stathopoulos et al. | ..... | 181/149 |
| 2011/0261986 | A1 * | 10/2011 | Murayama | ..... | 381/332 |
| 2012/0328146 | A1 | 12/2012 | Tsuruta et al. | | |
| 2013/0187523 | A1 | 7/2013 | Miyata et al. | | |
| 2013/0189918 | A1 | 7/2013 | Miyata et al. | | |

FOREIGN PATENT DOCUMENTS

| | | |
|---|---|---|
| JP | A-2002-323351 | 11/2002 |
| JP | A-2004-229340 | 8/2004 |
| JP | A-2006-101287 | 4/2006 |
| JP | A-2012-236520 | 12/2012 |
| JP | D-1461297 | 1/2013 |
| JP | A-2013-150264 | 8/2013 |
| JP | A-2014-024197 | 2/2014 |

OTHER PUBLICATIONS

U.S. Appl. No. 13/714,502, filed Dec. 14, 2012, Miyata et al.

* cited by examiner

*Primary Examiner* — Tuan D Nguyen
(74) *Attorney, Agent, or Firm* — Posz Law Group, PLC

(57) ABSTRACT

A housing structure for a sound generator includes a base portion having a separation wall; a case portion that defines a first space with the base portion; a covering portion that defines a second space with the base portion; a frame portion that projects toward the second space from the separation wall; a screen wall disposed on an outer side of the frame portion to define a groove between the screen wall and the frame portion; and a screen board arranged on an inner side of the screen wall. The screen board is distanced from the frame portion and the screen wall.

5 Claims, 3 Drawing Sheets

HOUSING STRUCTURE FOR SOUND GENERATOR

CROSS REFERENCE TO RELATED APPLICATION

This application is based on Japanese Patent Application No. 2012-011273 filed on Jan. 23, 2012, the disclosure of which is incorporated herein by reference in its entirety.

TECHNICAL FIELD

The present disclosure relates to a housing structure for a sound generator.

BACKGROUND

A housing for a sound generator is arranged outside of a vehicle, so the housing may be exposed to a foreign matter (fluid) such as rain water, cleaning liquid, snow-melted water, chemical solution or oil. The foreign matter may enter the housing from an opening of the housing, and may reach the sound generator. In this case, if the sound producing part of the sound generator receives the foreign matter, the sound (tone) quality of sound emitted from the sound producing part may be lowered or the sound producing part may be damaged.

Such a housing is described by, for example, JP-A-2006-101287A.

In JP-A-2006-101287A, the housing includes a sound emitting portion having plural holes, and sound produced by the sound producing part passes through the holes. A diameter of each inner side opening part of the hole is enlarged to define a water storage portion which collects and stores water passing through the holes.

However, the water storage portion may be sometimes ineffective if a jet of water comes from an oblique direction relative to the sound emitting portion, while the water storage portion can receive the jet of water coming perpendicularly to the front face of the sound emitting portion. If the jet of water collides with the sound producing part, the sound producing part may be damaged by the jet of water.

SUMMARY

It is an object of the present disclosure to provide a housing structure for a sound generator that is restricted from having damage.

According to an example of the present disclosure, a housing structure for a sound generator includes a base portion, a case portion, a covering portion, a frame portion, a screen wall, and a screen board. The base portion has a separation wall. The case portion defines a first space with the base portion. The covering portion defines a second space with the base portion. The frame portion projects toward the second space from the separation wall. The screen wall is disposed on an outer side of an outer circumference surface of the frame portion. A groove is defined between the screen wall and the frame portion. The screen board is arranged on an inner side of the screen wall in a manner that the screen board is distanced from the frame portion and the screen wall.

Accordingly, a sound generator arranged in the housing structure can be restricted from having damage.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1A:
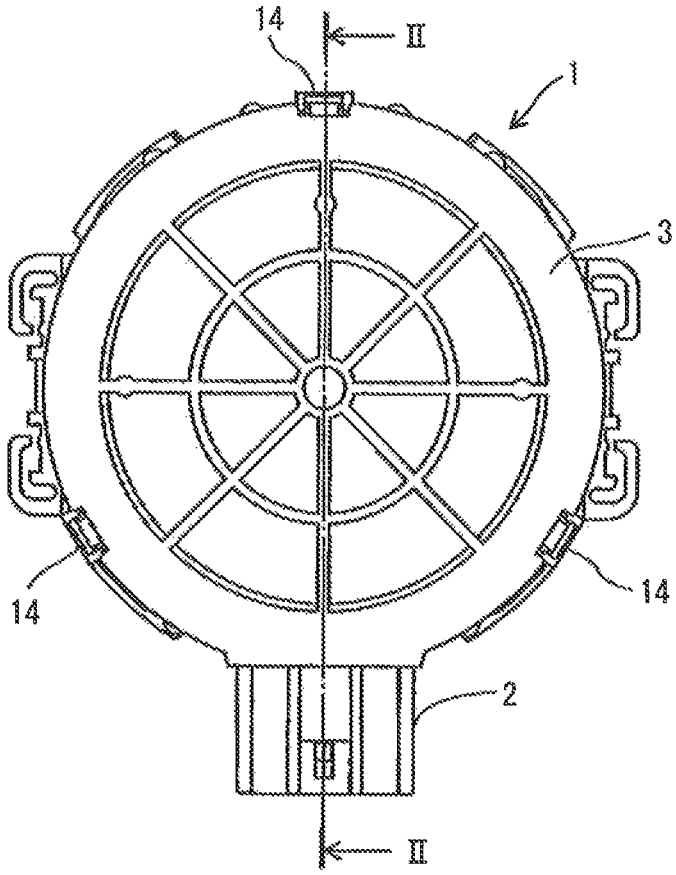
FIG. 1A is a front view illustrating a housing structure according to an embodiment.

An embodiment will be described with reference to FIGS. 1A-4.

A housing 1 includes a base portion 2, a case portion 4 and a covering portion 3, and a sound generating unit 5 is arranged in the housing 1. The base portion 2 is made of resin, and has a separation wall 6. The separation wall 6 is located at an intermediate part in the base portion 2 in an axial direction. The case portion 4 is made of resin, and air-tightly closes a first open end of the base portion 2 in the axial direction. The covering portion 3 is made of resin, and closes a second open end of the base portion 2 in the axial direction to prevent a foreign matter such as rain water drop from entering the housing 1.

Figure 2:
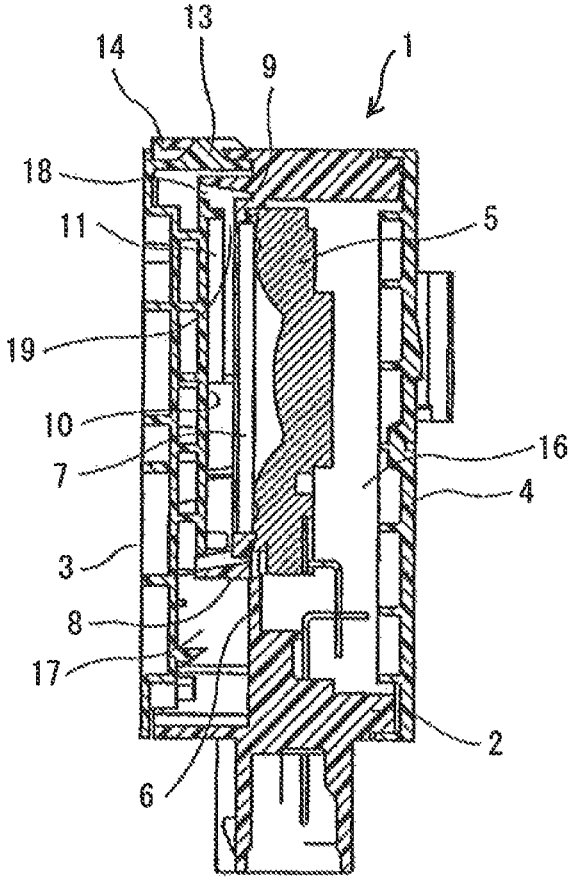
FIG. 2 is a schematic cross-sectional view taken along a line II-II of FIG. 1A.

As shown in FIG. 2, a first space 16 is defined by the separation wall 6 and the case portion 4, and a second space 17 is defined by the separation wall 6 and the covering portion 3. A ring-shaped frame portion 7 is arranged to the separation wall 6, and projects toward the second space 17 from the separation wall 6. A center of the frame portion 7 is deviated (upward in FIG. 2) from the center of the separation wall 6. The separation wall 6 has an opening corresponding to the shape of the frame portion 7. In other words, the inside of the frame portion 7 is hollow.

The frame portion 7 has an annular groove on a surface opposing to the first space 16. The sound generating unit 5 is mounted to the frame portion 7 in a manner that a convex part of an outer circumference of the sound generating unit 5 is fitted with the annular groove of the frame portion 7. That is, the frame portion 7 is projected from a sound producing part such as diaphragm of the sound generating unit 5.

The frame portion 7 has a shape to agree with an outer circumference shape of the sound generating unit 5, and the sound generating unit 5 is attached to the frame portion 7 in a manner that a sound emitting portion of the sound generating unit 5 is located inside of the frame portion 7.

Figure 3:
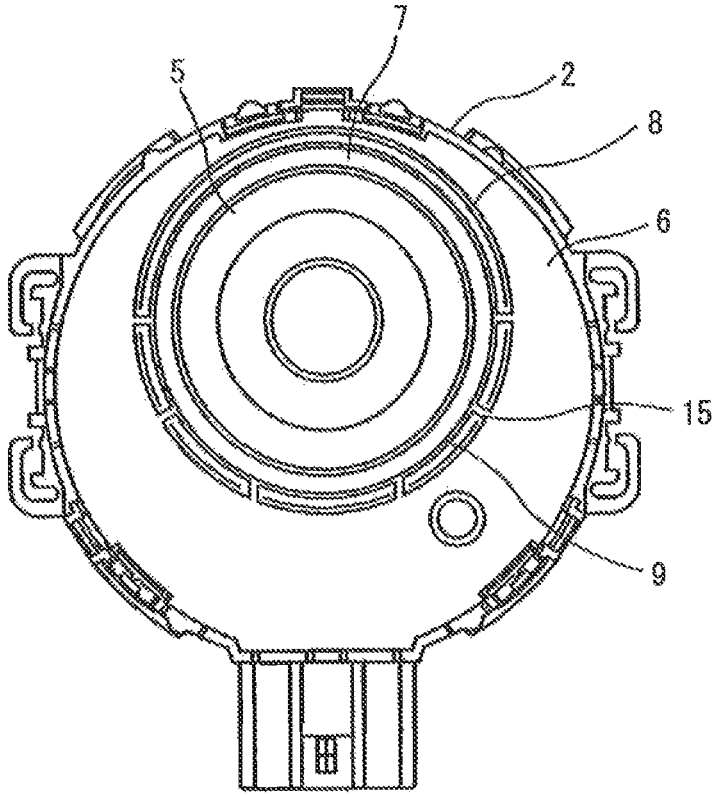
FIG. 3 is a front view illustrating the housing structure without a cover.

A screen wall 8 is arranged on the outer side of the outer circumference surface of the frame portion 7 in a radial direction. The screen wall 8 has a cylindrical shape with the same axis as the frame portion 7, and is projected from a surface of the separation wall 6 opposing to the second space 17. A groove 9 is defined between the outer circumference surface of the frame portion 7 and the inner circumference surface of the screen wall 8. As shown in FIG. 3, a lower half circumference of the screen wall 8 has plural slits 15. The slit 15 is defined by cutting the screen wall 8 to reach the separation wall 6.

Figure 4:
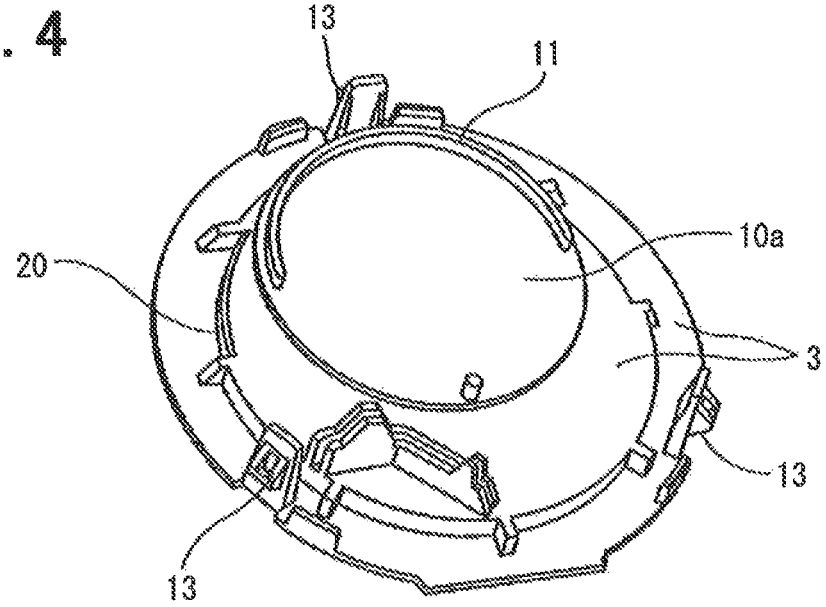
FIG. 4 is a perspective view illustrating the cover.

The outer face of the covering portion 3 is shown in FIG. 1A, the cross-sectional shape of the covering portion 3 is shown in FIG. 2, and the inner face of the covering portion 3 is shown in FIG. 4. As shown in FIGS. 1A, 2 and 4, the covering portion 3 has a recessed surface which is recessed from the most outer surface, and the recessed surface of the covering portion 3 has a rib shaped in circles having the same center and lines radially extending from the center.

As shown in FIG. 4, the covering portion 3 has an attachment part 13 arranged on an outer circumference edge of the covering portion 3. The attachment part 13 is detached from and attached to an attachment part 14 of the base portion 2. As shown in FIG. 1A, the base portion 2 has the attachment part 14 at positions corresponding to the attachment part 13 of the covering portion 3. The attachment part 14 is arranged on an outer circumference edge of the base portion 2, similarly to the attachment part 13. Thus, the covering portion 3 can be detached from and attached to the base portion 2. FIG. 4 illustrates the covering portion 3 which is removed from the base portion 2.

As shown in FIG. 2, a screen board 10 is disposed to the inner surface of the covering portion 3. The screen board 10 has approximately the same diameter as the frame portion 7, and is arranged at a position in a manner that the screen board 10 has the same axis as the screen wall 8. When the covering portion 3 is attached to the base portion 2, as shown in FIG. 2, the screen board 10 is located in the interior space of the screen wall 8. Further, the tip end of the screen wall 8 in the axial direction is located on the same plane as the rear face of the screen board 10. Furthermore, the screen board 10 is arranged on the rear face of the covering portion 3 in a manner that a first clearance 18 is defined between the outer circumference end of the screen board 10 and the inner circumference surface of the screen wall 8.

As shown in FIG. 4, the screen board 10 has a blocking portion 11 projected from an inner surface 10*a* of the screen board 10 in the axial direction. The inner surface 10*a* of the screen board 10 opposes to the frame portion 7, and the blocking portion 11 extends along an outer circumference edge of the surface 10*a* of the screen board 10. The blocking portion 11 is located along the upper half circumference edge of the screen board 10 to define an arc shape. As shown in FIG. 2, the tip end of the blocking portion 11 in the axial direction and the frame portion 7 oppose with each other through a second clearance 19, and have the same diameter as the arc shape.

Figure 1B:
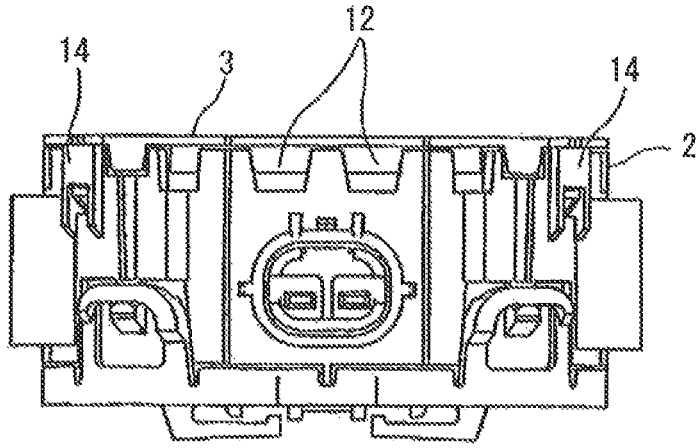
FIG. 1B is a bottom view illustrating the housing structure.

As shown in FIG. 4, an air hole 20 is perforated in a connecting part of the covering portion 3 which connects the recessed surface to the most outer surface. As shown in FIG. 1B, a water discharge port 12 is defined in an edge of the outer circumference surface of the base portion 2 opposing to the covering portion 3, by cutting the outer circumference surface of the covering portion 3.

Furthermore, as shown in FIG. 2, a gap is generated between the attachment part 13 of the covering portion 3 and the attachment part 14 of the base portion 2. Sound produced by the sound generating unit 5 is emitted outside through the air hole 20, the water discharge port 12 and the gap between the covering portion 3 and the base portion 2. However, a foreign matter (fluid) such as rain water, cleaning liquid, snow-melted water, chemical solution or oil may enter the housing 1 through the air hole 20, the water discharge port 12 and the gap between the covering portion 3 and the base portion 2.

According to the embodiment, the foreign matter is blocked by the screen wall 8 and the screen board 10, so the foreign matter is restricted from directly reaching the sound generating unit 5.

Moreover, in a case where the foreign matter may approach the sound generating unit 5 by flowing along the inner surface of the screen wall 8, the foreign matter is stopped by the outer surface of the frame portion 7 and the groove 9. When the housing 1 is mounted to a vehicle with the state shown in FIG. 1A, (i.e., when the up-and-down direction in FIG. 2 corresponds to the up-and-down direction in the vertical direction), the foreign matter flows along the outer surface of the frame portion 7 and the bottom part of the groove 9, and flows out of the screen wall 8 through the slit 15, due to the gravity force. Thus, the foreign matter is discharged from the water discharge port 12 after flowing along the surface of the separation wall 6 opposing to the second space 17.

It may be necessary to make a clearance between the screen board 10 and the frame portion 7 to be large as much as possible so as to effectively emit the sound generated by the sound generating unit 5. In contrast, the blocking portion 11 is placed at a position corresponding to the clearance which is most required for blocking the foreign matter. That is, because the foreign matter is most likely to enter the clearance between the attachment part 13 and the attachment part 14, the blocking portion 11 is located along the upper half circumference edge of the screen board 10, and the second clearance 19 is defined between the blocking portion 11 and the frame portion 7. In other words, the blocking portion 11 is placed adjacent to the clearance between the first attachment part 13 and the second attachment part 14, when the covering portion 3 and the base portion 2 are combined with each other through the first attachment part 13 and the second attachment part 14.

According to the embodiment, the housing 1 for the sound generating unit 5 includes the frame portion 7 provided to the separation wall 6. The frame portion 7 is projected toward the second space 17 from the sound generating unit 5, when the sound generating unit 5 is attached to the frame portion 7. Further, the screen wall 8 is formed on the outer side of the frame portion 7, and the clearance 9 is defined between the frame portion 7 and the screen wall 8. Furthermore, the screen board 10 is arranged on the inner side of the screen wall 8, and is distanced from the frame portion 7 and the screen wall 8.

Therefore, in addition to the advantage that the foreign matter is restricted from directly colliding with the sound generating unit 5, the foreign matter flowing along the screen wall 8 is restricted from approaching the sound generating unit 5. Thus, the foreign matter is restricted from adhering to the sound generating unit 5. Accordingly, the quality of sound generated by the sound generating unit 5 can be maintained better, and the sound generating unit 5 can be restricted from having damage.

The present disclosure may be carried out in the modes in which various change, revision, and improvement are added based on knowledge of a person skilled in the art.

In the above embodiment, as shown in FIG. 2, the bottom part of the groove 9 is located on the same plane as the surface of the separation wall 6 opposing to the second space 17, so as to make the foreign matter to flow easily. Alternatively, the bottom part of the groove 9 may be located on a plane different from the surface of the separation wall 6 opposing to the second space 17.

When the projection amount of the frame portion 7 in the axial direction is not enough, that is when the height of the frame portion 7 from the bottom part of the groove 9 is comparatively small, the bottom part of the groove 9 may be made to be located on the first space 16 side rather than the surface of the separation wall 6 opposing to the second space 17.

Such changes and modifications are to be understood as being within the scope of the present disclosure as defined by the appended claims.

What is claimed is:

1. A housing structure for a sound generator comprising:

a base portion having a separation wall;

a case portion that defines a first space with the base portion;

a covering portion that defines a second space with the base portion;

a frame portion arranged to the separation wall, the frame portion projecting toward the second space;

a screen wall disposed on an outer side of an outer circumference surface of the frame portion, a groove being defined between the screen wall and the frame portion; and a screen board arranged on an inner side of the screen wall in a manner that the screen board is distanced from the frame portion and the screen wall.

2. The housing structure according to claim 1, wherein the screen board has a surface opposing to the frame portion, and the screen board has a blocking portion extending along an outer circumference edge of the surface of the screen board.

3. The housing structure according to claim 1, wherein the screen wall has a slit.

4. The housing structure according to claim 1, wherein the frame portion has a shape to agree with an outer circumference shape of the sound generator, and the sound generator is attached to the frame portion in a manner that a sound emitting portion of the sound generator is located inside of the frame portion.

5. The housing structure according to claim 1, wherein the covering portion has a first attachment part, and the base portion has a second attachment part, and a clearance is defined between the first attachment part and the second attachment part, the covering portion and the base portion are combined with each other through the first attachment part and the second attachment part, and the blocking portion is placed adjacent to the clearance between the first attachment part and the second attachment part.

* * * * *